US008075371B1

(12) United States Patent
Cozart

(10) Patent No.: US 8,075,371 B1
(45) Date of Patent: Dec. 13, 2011

(54) CENTERLESS GRINDER WITH SERVO MOTOR

(76) Inventor: Brian Cozart, La Habra, CA (US)

( * ) Notice: Subject to any disclaimer, the term of this patent is extended or adjusted under 35 U.S.C. 154(b) by 824 days.

(21) Appl. No.: 12/171,163

(22) Filed: Jul. 10, 2008

(51) Int. Cl.
*B24B 1/00* (2006.01)

(52) U.S. Cl. ..... 451/28; 451/11; 451/190; 451/194; 451/407; 451/408

(58) Field of Classification Search ..... 451/28, 451/11, 190, 194, 407, 408
See application file for complete search history.

(56) References Cited

U.S. PATENT DOCUMENTS 2,464,845 A * 3/1949 Bodmer ..... 29/41
2,979,869 A 4/1961 Birleson et al.
4,783,932 A 11/1988 Sager
5,569,059 A 10/1996 Kirt
5,643,045 A 7/1997 Kirt
6,176,766 B1 1/2001 Silverman
6,244,930 B1 * 6/2001 Archilla ..... 451/6

* cited by examiner

*Primary Examiner* — Maurina Rachuba
(74) *Attorney, Agent, or Firm* — Kenneth L. Green

(57) ABSTRACT

Apparatus and method for converting a convention centerless grinding machine to a centerless grinding machine having a servo motor mounted inside the top slide using an internal servo motor bracket. The servo motor bracket is bolted to the spindle head assembly housing and is cantilevered into the top slide to allow required tilt adjustment of the regulating wheel with respect to the top slide while maintaining correct alignment of the servo motor with the regulating wheel spindle. The bracket includes slots allowing a servo motor belt tension to be adjusted. The tension adjustments are conveniently made through an existing opening in the top slide. Locating the servo motor inside the top slide using the internal servo motor bracket of the present invention significantly reduces conversion costs and servo motor maintenance otherwise required by the environment the centerless grinder is operated in, for example, oils and the presence of metal grindings.

10 Claims, 4 Drawing Sheets

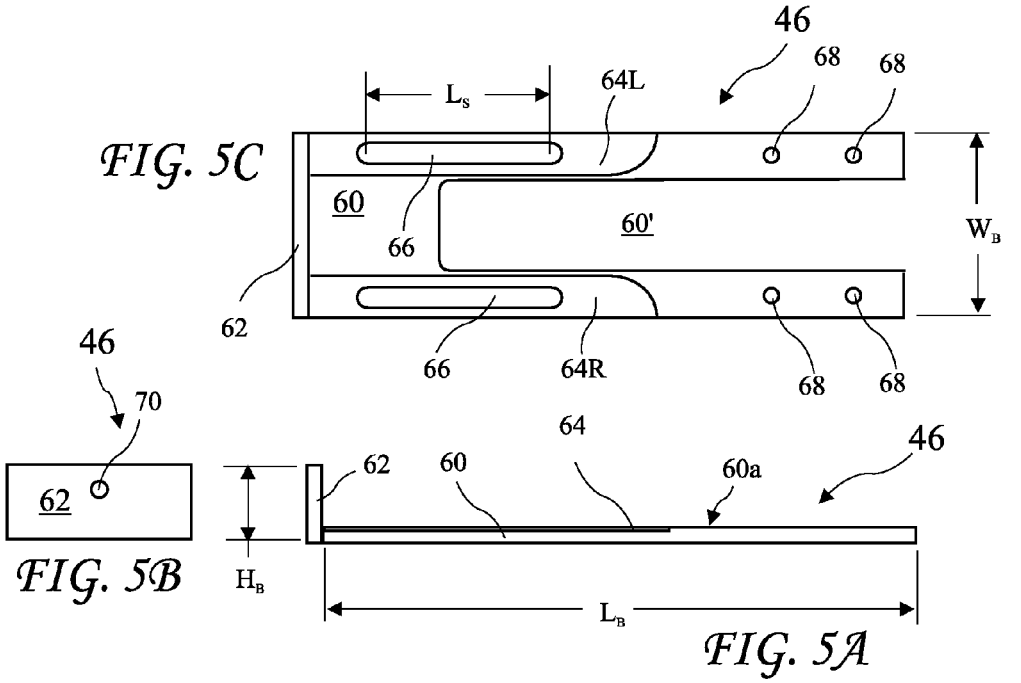
FIG. 5C
FIG. 5B
FIG. 5A
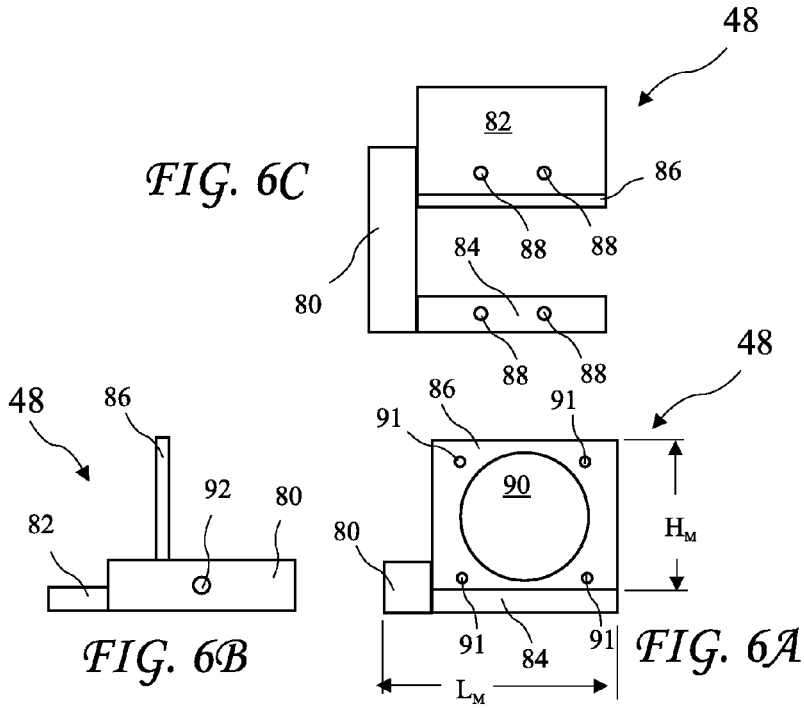
FIG. 6C
FIG. 6B
FIG. 6A

CENTERLESS GRINDER WITH SERVO MOTOR

BACKGROUND OF THE INVENTION

The present invention relates to centerless grinding machines and in particular to conversion of a centerless grinding machine to use a servo motor to drive the regulating wheel.

Centerless grinding machines have long been utilized for providing very precise cylindrical parts and very smooth finishes. The machines provide a workpiece rest for supporting a workpiece between a grinding wheel and a regulating wheel. Conventional centerless grinding machines include a large constant speed electric motor connected to the regulating wheel through a series of gears, chains, and idlers. The gears allow the speed of the regulating wheel to be selected for grinding various materials and workpiece sizes. Unfortunately, the gears, chains, and idlers of convention centerless grinding machines are expensive to maintain and introduce mechanical vibrations into the regulating wheel which reduce the precision of the machine.

A known conversion for a centerless grinding machine directly connected a servo motor to a replacement regulating wheel spindle. As a result, the electric servo motor is exposed to the metal grindings necessarily resulting from the operation of the centerless grinder. Such exposure to very fine metal grindings creates a need for frequent maintenance and also results in shortened motor life. Further, the regulating wheel spindle is a very expensive element of a centerless grinding machine and such replacement is very high cost.

U.S. Pat. No. 5,569,059 for "System For Driving a Centerless Grinder Regulating Wheel" discloses a centerless grinding machine conversion including a speed controlled electric servo motor 106 mounted beside a top slide 100 and connected to the regulating wheel through a cylindrical cam unit 110 mounted inside the top slide. Further, U.S. Pat. No. 5,643,045 for "Retrofit Kit For Driving the Regulating Wheel of a Centerless Grinder," discloses a conversion to an electric motor 26. The motor is mounted externally to the top slide 32 and drives the regulating wheel through a speed reducer and a toothed belt. The electric motor is mounted using an adapter plate which may be rotated to adjust belt tension. While both the '059 and the '045 patents replace the gears, chains, and idlers with an electric servo motor, the electric servo motor is again exposed to the metal grindings resulting from the operation of the centerless grinder and results in a need for frequent maintenance and short motor life. The '059 and the '045 patents are herein incorporated in their entirety by reference.

BRIEF SUMMARY OF THE INVENTION

The present invention addresses the above and other needs by providing apparatus and method for converting a conventional centerless grinding machine to a centerless grinding machine having a servo motor mounted inside the top slide using an internal servo motor bracket. The servo motor bracket is bolted to the spindle head assembly housing and is cantilevered into the top slide to allow required tilt adjustment of the regulating wheel with respect to the top slide while maintaining correct alignment of the servo motor with the regulating wheel spindle. The bracket includes slots allowing a servo motor belt tension to be adjusted. The tension adjustments are conveniently made through an existing opening in the top slide. Locating the servo motor inside the top slide using the internal servo motor bracket of the present invention significantly reduces conversion costs and servo motor maintenance otherwise required by the environment the centerless grinder is operated in, for example, oils and the presence of metal grindings.

In accordance with one aspect of the invention, there is provided a modified centerless grinding machine including a base, a grinding wheel housing mounted to the base and a top slide residing on the base opposite the grinding wheel housing and slidable towards and away from the grinding wheel housing. A grinding wheel rotatably resides in the grinding wheel housing and the regulating wheel housing is pivotally attached to the top slide facing the grinding wheel housing and slidable with the top slide. A regulating wheel spindle rotatably resides in the regulating wheel housing and is pivotable with the regulating wheel housing and the regulating wheel is attached to rotate with the regulating wheel spindle. A regulating wheel pulley is attached to the regulating wheel spindle for rotating the regulating wheel spindle and the regulating wheel. An electric motor is supported entirely inside the top slide by a cantilevered motor bracket to turn the regulating wheel and a speed reducer is attached to the electric motor for reducing the speed which the electric motor turns the regulating wheel. The cantilevered motor bracket includes a cantilevered motor bracket base attached to the regulating wheel housing and pivots with the regulating wheel housing and reaches inside the top slide. The motor is attached to the cantilevered motor bracket by a sliding bracket which is slidably attached to the cantilevered motor bracket base and slidable towards and away from the regulating wheel spindle to adjust belt or chain tension. The electric motor resides entirely inside the top slide to reduce or eliminate exposure to the hash environment the centerless grinding machine operates in.

In accordance with another aspect of the invention, there is provided a method for improving a centerless grinding machine. The method includes the steps of disassembling a chain and idlers for driving a regulating wheel from a centerless grinding machine, separating a regulating wheel spindle head assembly housing from a top slide of the centerless grinding machine, drilling & tapping the regulating wheel spindle head assembly housing for later installation of a servo motor bracket, replacing a regulating wheel spindle sprocket with a belt pulley, reattaching the regulating wheel spindle head assembly housing to the top slide, bolting the servo motor bracket to the regulating wheel spindle head assembly housing through an opening into the top slide, mounting a servo motor to the servo motor bracket inside the top slide, installing a belt between the servo motor and the regulating wheel, and calibrating spindle RPM to a tachometer.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 5A is a side view of a servo motor bracket base according to the present invention.

FIG. 5B is an end view of the servo motor bracket base according to the present invention.

FIG. 5C is a top view of the servo motor bracket base according to the present invention.

FIG. 6A is a side view of a servo motor bracket slider according to the present invention.

FIG. 6B is an end view of the servo motor bracket slider according to the present invention.

FIG. 6C is a top view of the servo motor bracket slider according to the present invention.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
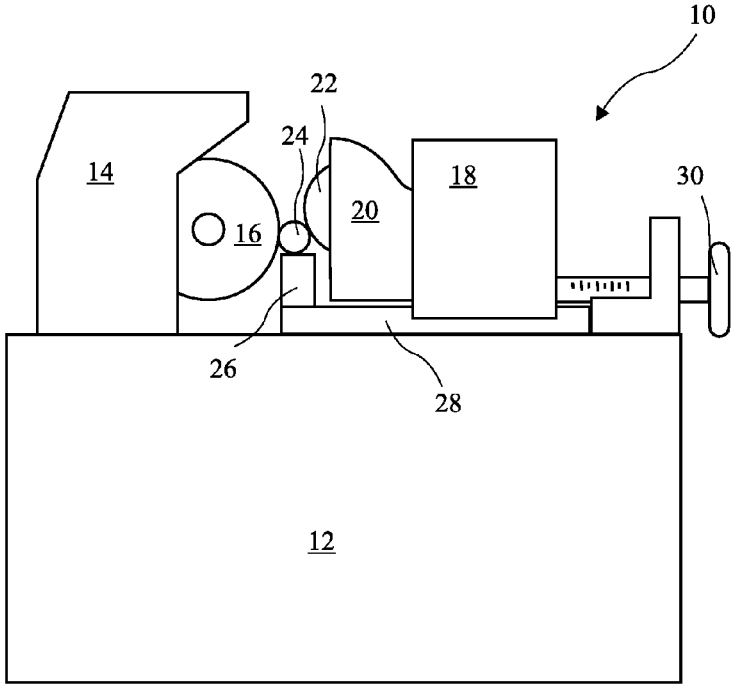
FIG. 1 (prior art)
FIG. 1 is a prior art centerless grinding machine.

A centerless grinding machine 10 is shown in FIG. 1. The machine 10 includes a base 12, a grinding wheel housing 14, a grinding wheel 16, a top slide 18, and regulating wheel housing 20 attached to the top slide 18, a regulating wheel 22 facing the grinding wheel, and a workpiece holder 26. The workpiece holder 26 supports a cylindrical workpiece 24 which is rotated by the regulating wheel 22 and ground by the grinding wheel 16. The top slide 18 slides in rails (or ways 28) and is positionable by a top slide screw 30.

Figure 2:
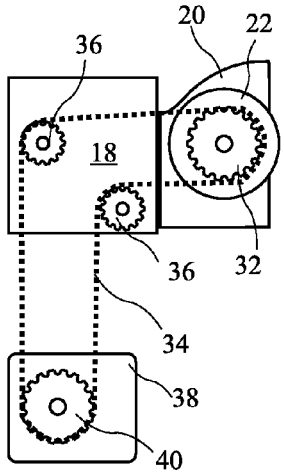
FIG. 2 (prior art)
FIG. 2 is a transmission, chain and idler assembly of the prior art centerless grinding machine.

Known centerless grinding machines include a single speed electric motor, a transmission 38 having a transmission sprocket 40, a chain 34 and idlers 36 connecting the transmission sprocket 40 to a regulating wheel (or spindle) sprocket 32 for turning the regulating wheel 22 at a desired speed are shown in FIG. 2. Such known machines are described in more detail in the '059 and the '045 patents incorporated above by reference.

Figure 3A:
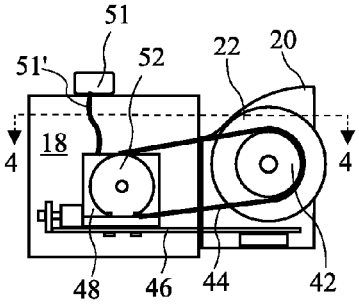
FIG. 3A shows a side view of a servo motor and bracket mounted inside a top slide according to the present invention.
Figure 3B:
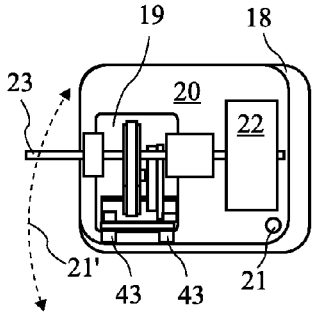
FIG. 3B shows an end view of a servo motor and bracket mounted inside a top slide according to the present invention.
Figure 4:
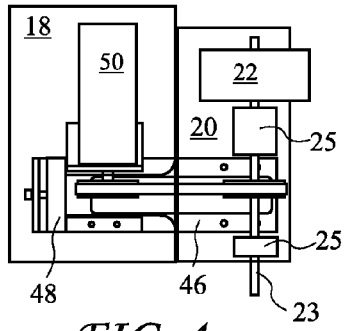
FIG. 4 is a cross-sectional view of the servo motor and bracket mounted inside a top slide according to the present invention taken along line 4-4 of FIG. 3A.

The present invention provides an improved apparatus and method for replacing the constant speed electric motor, gears, chains, and idlers with a servo motor 50 mounted inside the top slide 18, and therefor not exposed to the working environment of the centerless grinder, for example, oils and grinding material. The servo motor 50 mounted to a cantilevered motor bracket 45 (see FIGS. 7A and 7B) is shown in side view in FIG. 3A and end view in FIG. 3B. A cross-sectional view of the cantilevered motor bracket 45 and the servo motor 50 mounted to the cantilevered motor bracket 45 inside the top slide 18 taken along line 4-4 of FIG. 3A is shown in FIG. 4. The idlers and the chain resided in the top slide 18 and their removal provides space for the servo motor 50 and the cantilevered motor bracket 45. The cantilevered motor bracket 45 is attached to the regulating wheel housing 20 and passes through an opening 19 into the top slide 18. The regulating wheel housing 20 is pivotally mounted to the top slide 18 with a pivot point 21 and is adjustable along an arc 21' to tilt the regulating wheel 22 to adjust the operation of the centerless grinding machine 10. Bolting, or otherwise attaching the motor bracket base 46 to the regulating wheel housing 20 allows the servo motor 50 to remain aligned with the regulating wheel spindle 23 when the regulating wheel housing 20 tilt is changed, thus allowing the servo motor 50 to reside inside the top slide.

A servo motor pulley 52 is turned by the servo motor 50 and is connected to a regulating wheel pulley 42 by at least one belt 44, which belt 44 is preferably a timing belt but may be any appropriate belt or a chain, in which instance the pulleys 52 and 42 are sprockets. Preferably, the cantilevered motor bracket 45 is adjustable to adjust the spacing between the servo motor pulley 52 and the regulating wheel pulley 42 to adjust the tension of the belt 44. Alternatively, the cantilevered motor bracket 45 may be adjustably mounted to the regulating wheel housing 20 to adjust the tension of the belt 44. In another embodiment, the spacing between the servo motor pulley 52 and the regulating wheel pulley 42 is fixed, and an adjustable idle wheel is provided to adjust belt 44 tension.

The regulating wheel 22 is mounted to the regulating wheel spindle 23 and the regulating wheel spindle 23 is supported by bearings 25 on both sides of the regulating wheel pulley 42. A control and/or display 51 is mounted on top of the top slide 18 and electrically connected to a power source and to the servo motor 50 by a cable 51'.

A detailed side view of the motor bracket base 46 according to the present invention is shown in FIG. 5A, an end view of the motor bracket base 46 is shown in FIG. 5B, and a top view of the motor bracket base 46 is shown in FIG. 5C. The motor bracket base 46 has a base length $L_B$, a base width $W_B$ and a base height $H_B$. The base length $L_B$ is preferably approximately 14.5 inches, the base width $W_B$ is preferably approximately 4.5 inches, and the base height $H_B$ is approximately 1¾ inches.

The motor bracket base 46 includes a base plate 60 having four mounting holes 68 for bolting the motor bracket base 46 to the regulating wheel housing 20. Slots 60 in the base plate 60 opposite the mounting holes 68 are provided for adjustably mounting a sliding bracket 48 to the motor bracket base 46. An end piece 62 is attached to the end of the base plate 60 opposite the mounting holes 68 and includes a tensioning bolt 96 passage 70 for adjusting the tension of a belt 44 (see FIGS. 7A and 7B) rotationally connecting the servo motor 50 to the regulating wheel 22. Guides 64L and 64R are machined in the surface 60*a* of the base plate 60. The guides 64L and 64R include a straight portion running lengthwise on the base plate 60 for guiding the sliding bracket 48 and include outward flaring portions providing a stop for the sliding bracket 48. Blocks 43 may be required to lift the motor bracket base 46 to pass through the opening 19 (see FIG. 3B) into the top slide 18. A pair of parallel slots 66 are provided for adjustably mounting the sliding bracket 48 to the base plate 60. The base plate 60 includes a cut out center region 60' extending from approximately the center of the slots 66 to the opposite end of the base plate 60 which may provide clearance for the regulating wheel pulley 42 if necessary.

A side view of the sliding bracket 48 according to the present invention is shown in FIG. 6A, an end view of the sliding bracket 48 is shown in FIG. 6B, and a top view of the sliding bracket 48 is shown in FIG. 6C. The sliding bracket 48 includes a left plate 82 and a right arm 84 both having a pair of slider bolt passages 88 for receiving bolts inserted through the slots 66 on the base plate 60. The sliding bracket 48 also includes a backing 80 connecting the left plate 82 and the right arm 84 and having a threaded passage 92 aligned with the passage 70 in the end piece 62 (see FIG. 5B) for drawing the sliding bracket 48 towards the end piece 62 to tighten the belt 44 (see FIG. 3A). The sliding bracket 48 further includes a vertical motor plate 86 attached to the left plate 82. The motor plate 86 includes a mouth 90 for passage of the servo motor 50 and motor attaching holes 91 for attachment of the servo motor 50 to the motor plate 86.

Figure 7B:
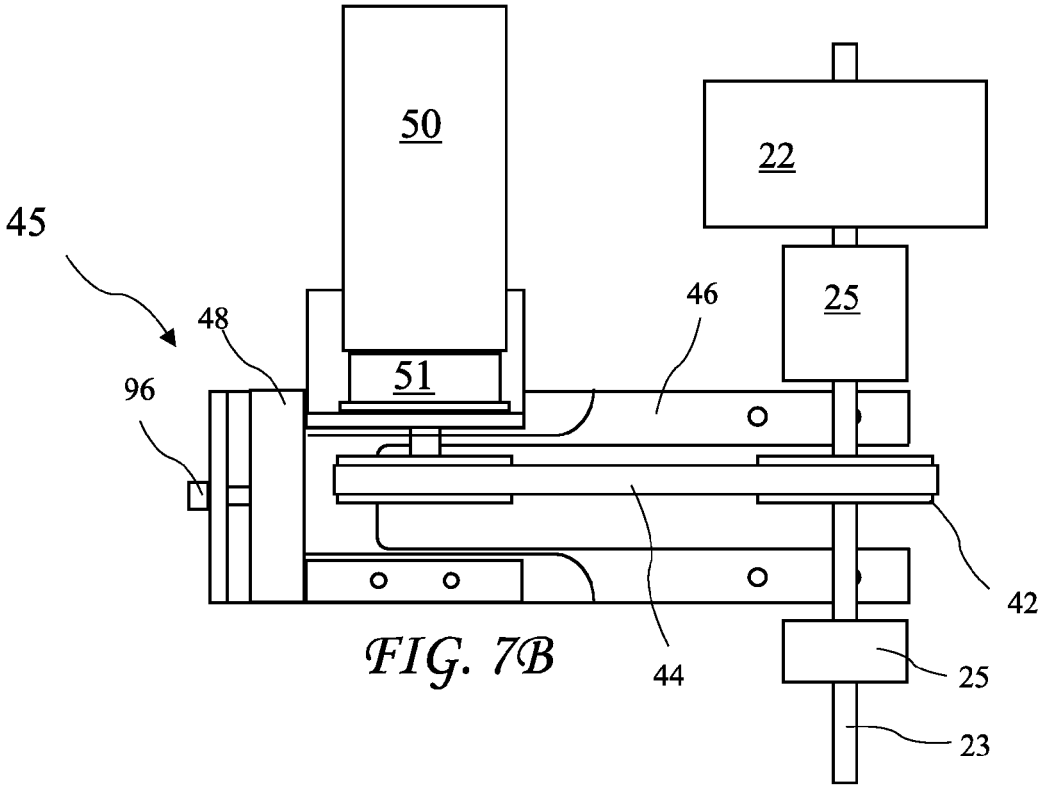
FIG. 7B is a top view of the servo motor mounted in the servo motor bracket.
Figure 7A:
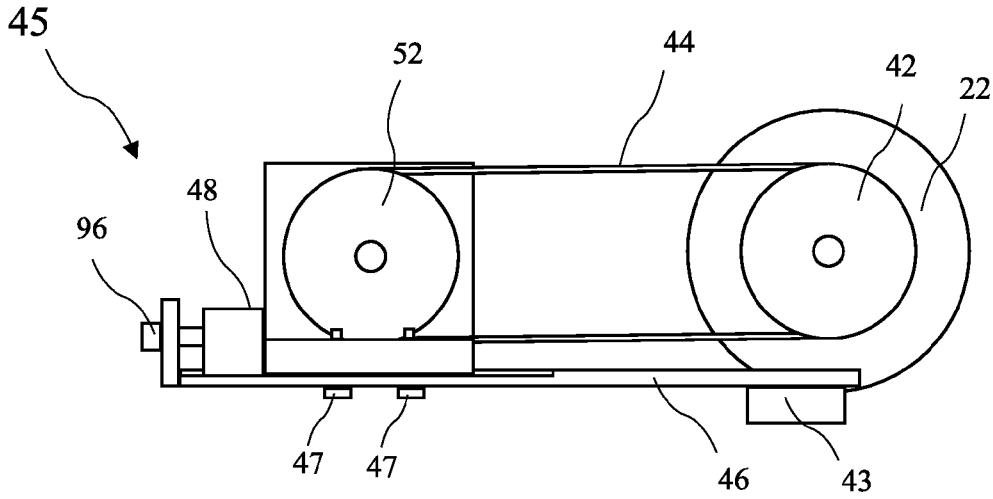
FIG. 7A is a side view of the servo motor mounted in the servo motor bracket.

A side view of the servo motor 50 and speed reducer 51 mounted to the assembled cantilevered motor bracket 45 comprising the motor bracket base 46 and the sliding bracket 48 is shown in FIG. 7A and a top view of the servo 50 motor mounted in the cantilevered motor bracket 45 is shown in FIG. 7B. The left plate 82 and the right arm 84 of the motor bracket base 46 are centered by guides 64L and 64R and by slider bolts 47 passing through the slots 66 (see FIG. 4C) and into the slider bolt passages 88 (see FIG. 6C) to hold the sliding bracket 48 against the motor bracket base 46. An example of a suitable servo motor 50 is a model IG34CK-64-1E2000-S365 motor made Servo Dynamics in Chatsworth, Calif. and an example of a suitable speed reducer 51 is a model 034VPX0100-XX-34N16 made by CGI, Inc. in Carson City, Nev. The servo motor 51 is preferably a 22 Lb-In 3.5 amp 8,000 RPM servo motor and the speed reducer 51 is preferable a 10 to 1 speed reducer and more preferably a planetary gear speed reducer.

Figure 8:
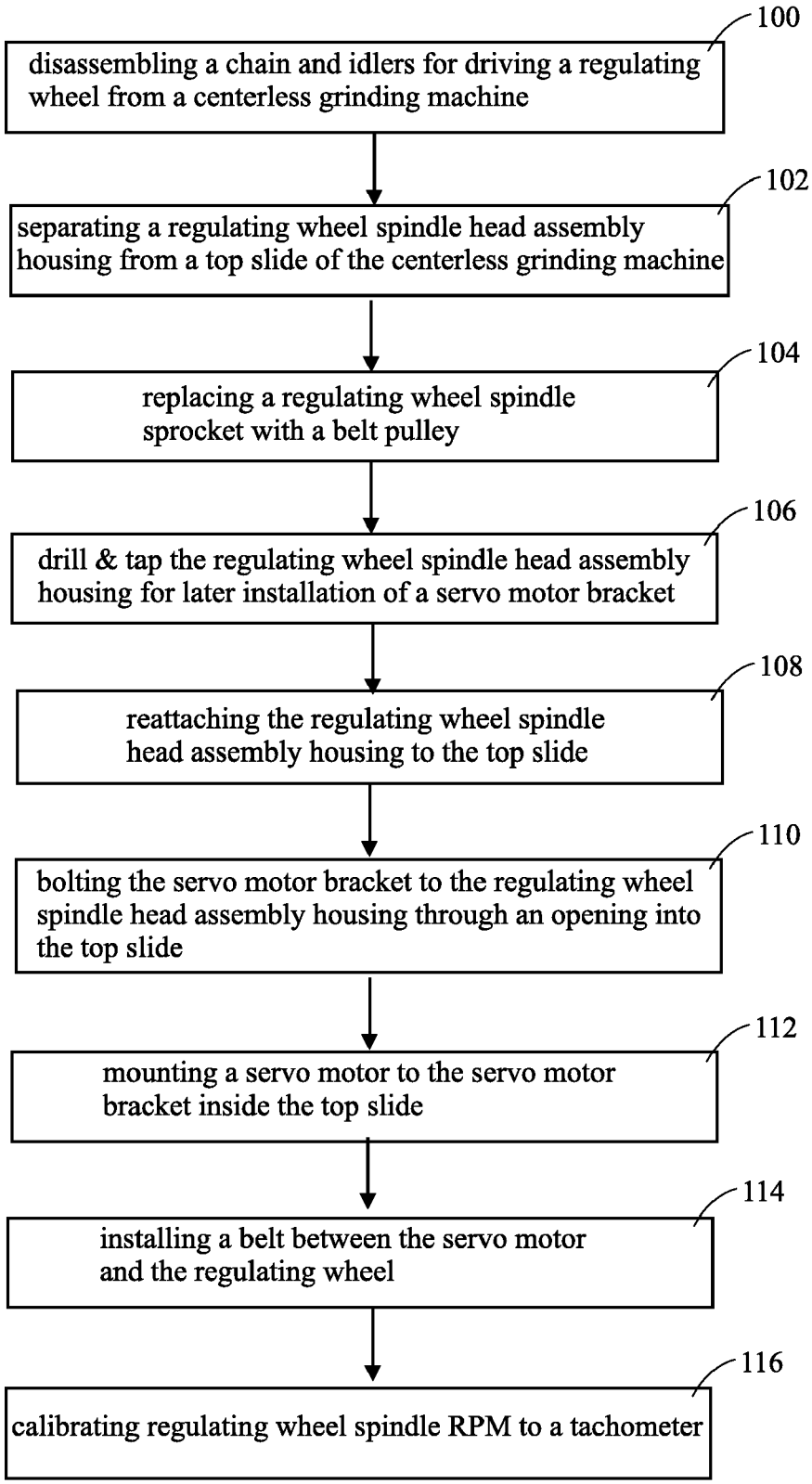
FIG. 8 is a method for converting the centerless grinding machine to use a servo motor powered regulating wheel according to the present invention.

A method for converting the centerless grinding machine to use a servo motor powered regulating wheel according to the present invention is described in FIG. 8. The method includes disassembling a chain and idlers for driving a regulating wheel from a centerless grinding machine at step 100, separating a regulating wheel spindle head assembly housing from a top slide of the centerless grinding machine at step 102, replacing a regulating wheel spindle sprocket with a belt pulley at step 104, drilling & tapping the regulating wheel spindle head assembly housing for later installation of a servo motor bracket at step 106, reattaching the regulating wheel spindle head assembly housing to the top slide at step 108, bolting the servo motor bracket to the regulating wheel spindle head assembly housing through an opening into the top slide at step 110, mounting a servo motor to the servo motor bracket inside the top slide at step 112, installing a belt between the servo motor and the regulating wheel at step 114, and calibrating regulating wheel spindle RPM to a tachometer at step 116.

Bolting the servo motor bracket to the regulating wheel spindle head assembly housing at step 110 generally comprises bolting a cantilevered servo motor bracket to the regulating wheel spindle head assembly housing where the cantilevered servo motor bracket reaches into the top slide. Installing a belt at step 114 generally includes adjusting the tension of the belt. Such adjusting may be by adjusting a sliding bracket attached to the cantilevered servo motor bracket, adjusting the cantilevered servo motor bracket attachment to the regulating wheel spindle head assembly housing, or adjusting an idler wheel.

The drilling & tapping the regulating wheel spindle head assembly housing for later installation of a servo motor bracket at step 106 is generally done after replacing a regulating wheel spindle sprocket with a belt pulley at step 104 because the location of the drilled and tapped holes is preferably determined by the position of the pulley. However, in some instances the spindle sprocket may be retained and a chain used between the servo motor and the regulating wheel. Further, for repeated conversion of identical or similar machines, and template may be used to determine the positions of the drilled and tapped holes.

The servo motor bracket is preferably bolted to the regulating wheel spindle head assembly housing through an opening into the top slide after reattaching the regulating wheel spindle head assembly housing to the top slide because of the very limited working space between the top slide and the grinding wheel housing. However, in the instances of some centerless grinding machines, it may be possible to mount the servo motor bracket to the regulating wheel spindle head assembly housing and then reattach the regulating wheel spindle head assembly housing to the top slide, and any method for improving a centerless grinding machine by installing a servo motor in the top slide to a servo motor bracket attached to the regulating wheel spindle head assembly housing is intended to come within the scope of the present invention.

An example of centerless grinding machines 10 suitable for the modifications described above are Cincinnati models OM or EA centerless grinding machines.

While the invention herein disclosed has been described by means of specific embodiments and applications thereof, numerous modifications and variations could be made thereto by those skilled in the art without departing from the scope of the invention set forth in the claims.

I claim:

1. A method for improving a centerless grinding machine, the method comprising:

disassembling a chain and idlers for driving a regulating wheel from a centerless grinding machine;

separating a regulating wheel spindle head assembly housing from a top slide of the centerless grinding machine;

drilling & tapping the regulating wheel spindle head assembly housing for installation of a servo motor bracket;

reattaching the regulating wheel spindle head assembly housing to the top slide;

mounting a servo motor to a cantilevered servo motor bracket residing inside the top slide, the cantilevered servo motor bracket carried by the regulating wheel spindle head assembly housing and cantilevered into the top slide to allow the regulating wheel spindle head assembly housing to be tilted with respect to the top slide; and installing a belt between the servo motor and the regulating wheel.

2. The method of claim 1, further including replacing a regulating wheel spindle sprocket with a belt pulley before drilling & tapping the regulating wheel spindle head assembly housing for later installation of the servo motor bracket.

3. The method of claim 1, further including bolting the servo motor bracket to the regulating wheel spindle head assembly housing through an opening into the top slide after reattaching the regulating wheel spindle head assembly housing to the top slide.

4. The method of claim 1 wherein mounting a servo motor to a servo motor bracket inside the top slide comprises mounting a servo motor through an opening into the top slide, after reattaching the regulating wheel spindle head assembly housing to the top slide, to a servo motor bracket inside the top slide.

5. The method of claim 1, further including calibrating spindle RPM to a tachometer after reassembling the centerless grinding machine.

6. A method for improving a centerless grinding machine, the method comprising:

disassembling a chain and idlers for driving a regulating wheel from a centerless grinding machine;

separating a regulating wheel spindle head assembly housing from a top slide of the centerless grinding machine;

replacing a regulating wheel spindle sprocket with a belt pulley drilling & tapping the regulating wheel spindle head assembly housing for installation of a servo motor bracket;

reattaching the regulating wheel spindle head assembly housing to the top slide;

bolting the servo motor bracket to the regulating wheel spindle head assembly housing through an opening into the top slide;

mounting a servo motor to the servo motor bracket residing inside the top slide, the cantilevered servo motor bracket carried by the regulating wheel spindle head assembly housing and cantilevered into the top slide to allow the regulating wheel spindle head assembly housing to be tilted with respect to the top slide; and installing a belt between the servo motor and the regulating wheel.

7. The method of claim 6, wherein mounting a servo motor to the servo motor bracket comprises mounting the servo motor and a speed reducer to the servo motor bracket.

8. The method of claim 6, wherein mounting a servo motor to the servo motor bracket comprises mounting the servo motor to a sliding motor bracket element of the servo motor bracket residing inside the top slide allowing adjustment of belt tension.

9. The method of claim 6, wherein bolting the servo motor bracket to the regulating wheel spindle head assembly housing comprises bolting the servo motor bracket including an idler wheel for belt adjustment to the regulating wheel spindle head assembly housing through an opening into the top slide.

10. A method for improving a centerless grinding machine, the method comprising:

disassembling a chain and idlers for driving a regulating wheel from a centerless grinding machine;

separating a regulating wheel spindle head assembly housing from a top slide of the centerless grinding machine;

replacing a regulating wheel spindle sprocket with a belt pulley drilling & tapping the regulating wheel spindle head assembly housing for attachment of a servo motor bracket;

reattaching the regulating wheel spindle head assembly housing to the top slide;

positioning the servo motor bracket with respect to the regulating wheel spindle head assembly housing through an opening between the regulating wheel spindle head assembly housing and the top slide;

bolting the servo motor bracket to the regulating wheel spindle head assembly housing in a cantilevered relationship to the regulating wheel spindle head assembly housing thereby forcing the servo motor bracket to move with the regulating wheel spindle head assembly housing and independently of the top slide;

mounting a servo motor to a sliding motor bracket element of the servo motor bracket residing inside the top slide;

installing a belt between the servo motor and the regulating wheel; and adjusting a position of the sliding motor bracket with respect to the belt pulley to adjust the belt.

* * * * *